US011806561B2

(12) United States Patent
Howard

(10) Patent No.: US 11,806,561 B2
(45) Date of Patent: Nov. 7, 2023

(54) HAIR INFUSED FIRE SUPPRESENT METHOD AND APPARATUS

(71) Applicant: Chera Howard, Prattville, AL (US)

(72) Inventor: Chera Howard, Prattville, AL (US)

( * ) Notice: Subject to any disclaimer, the term of this patent is extended or adjusted under 35 U.S.C. 154(b) by 0 days.

(21) Appl. No.: 17/989,880

(22) Filed: Nov. 18, 2022

(65) Prior Publication Data

US 2023/0149752 A1 May 18, 2023

Related U.S. Application Data

(60) Provisional application No. 63/280,661, filed on Nov. 18, 2021.

(51) Int. Cl.
*A62C 3/02* (2006.01)

(52) U.S. Cl.
CPC ..... *A62C 3/0257* (2013.01)

(58) Field of Classification Search
CPC .... A01G 13/0268; A01G 20/20; A01G 24/44; A01G 25/02; A62C 3/0257
USPC ..... 169/48–50
See application file for complete search history.

(56) References Cited

U.S. PATENT DOCUMENTS

| | | | | |
|---|---|---|---|---|
| 7,553,782 | B2 * | 6/2009 | Byles | D02G 3/443 442/310 |
| 2002/0098322 | A1 * | 7/2002 | Cripp | E02D 17/202 442/104 |
| 2006/0032116 | A1 * | 2/2006 | Milliken | A01G 25/02 47/21.1 |
| 2006/0070294 | A1 * | 4/2006 | Spittle | A01G 13/0268 47/9 |
| 2006/0150476 | A1 * | 7/2006 | McCrory | A01G 13/0281 47/32 |
| 2017/0359967 | A1 * | 12/2017 | Tetrault | A41F 3/00 |

* cited by examiner

*Primary Examiner* — Cody J Lieuwen
(74) *Attorney, Agent, or Firm* — Dale J. Ream

(57) ABSTRACT

A method and apparatus for using hair infused mats which may be pretreated so as to be fire resistant and selectively over-saturated with water may be positioned underneath a sod surface for suppressing a migrating fire. The mat may be saturated using a slow drip irrigation system that also enhances a root system of integrated vegetation. In addition, forms of Afro hair may be delivered aerially to suppress a fire.

12 Claims, 19 Drawing Sheets

HAIR INFUSED FIRE SUPPRESENT METHOD AND APPARATUS

REFERENCE TO RELATED APPLICATIONS

This application claims the priority of provisional patent application 63/280,661 filed Nov. 18, 2021 entitled Hair Infused Fire Suppressant Method and Apparatus which claims the priority of non-provisional patent application Ser. No. 17/358,839 filed Jun. 25, 2021, titled Apparatus and Method Using Natural Fibers to Enhance Plant Growth, which claims the priority of provisional patent application 62/897,656 filed Sep. 9, 2019, titled Method for Speeding Photosynthesis in Plants.

BACKGROUND OF THE INVENTION

This invention relates generally to fire suppressant methods and devices and, more particularly, to a method and apparatus for using hair infused mats that may be positioned underneath a side surface and which may be pretreated so as to be selectively over-saturated with water for stopping a migrating fire event.

Fast-moving fire events seem to rage every year in drought-stricken parts of the United States, e.g., in California, Texas, and other states. Out of control fires can travel and consume forests, prairies, and houses with incredible speed, making them ever so difficult to control or extinguish. For instance, studies show that fires can move as fast as 10.8 kilometers per hour (6.7 mph) in forests and 22 kilometers per hour (14 mph) in grasslands. Various methods and techniques have been used or proposed in the art attempting to slow or stop fast-moving fires, such as control lines, burnouts, back burns, aerial attack, and the like. Although presumably effective for their intended purposes, there is still a need for a barrier capable of holding water and that is fire resistant that may be pre-positioned underneath the sod and turf in areas likely to be at risk of a fire event or that requires a degree of special protection.

Therefore, it would be desirable to have a method and apparatus that may be pre-positioned in the soil of a desired location, which may be saturated with water via drip irrigation hoses and which may include hair bundles infused with fertilizer, weed suppressant treatments, and which provide nitrogen that is flame and fire resistant. The apparatus described herein may include a mat formed using hair collected from men of African descent (also referred to as Afro Hair) having melanin that is prone to bind with other chemicals and be useful as fire retardant.

SUMMARY OF THE INVENTION

A method for slowing or suppressing a fire event according to the present invention includes at least all the following critical steps:

- collecting a plurality of hair fibers;
- cleansing and agitating the collected hair fibers deposited in a cleaning assembly;
- while in said cleaning assembly, shaping said agitated hair fibers into a bundle such as a mat, balls, or powder;
- infusing a water and nitrogen-rich solution into the bundle; and
- positioning said infused bundle on or into sod or turf or otherwise positioned yet for fire suppression purposes.

Therefore, a general object of this invention is to provide a method and apparatus for slowing or suppressing a fire event using human hair that may be agitated and infused with water and fertilizer and that generates nitrogen which may be added to or positioned beneath sod or turf and irrigated or saturated with water so as to slow or prevent migration of mass fire events in a treated area.

Another object of this invention is to provide a method and apparatus, as aforesaid, that produces vegetation having fire retardant properties.

Still another object of this invention is to provide a method and apparatus, as aforesaid, that conserves water and uses drip irrigation that more effectively reaches the root system.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

A method and apparatus for slowing or suppressing a fire event according to a preferred embodiment of the present invention will now be described with reference to FIG. 1 to 17 of the accompanying drawings.

Utilizing the various forms for the hair bundles 60 for extinguishing or suppressing a fire will now be described in greater detail. According to the present invention, mats 70 may be placed underneath the sod and turf and used as defensive barriers to stop fires from spreading and burning homes and property, and for water conservation. Marketed as the "Forsee mats," respective mats hold water and provide nitrogen to sod/turf which renders it flame and fire resistant.

Figure 7:
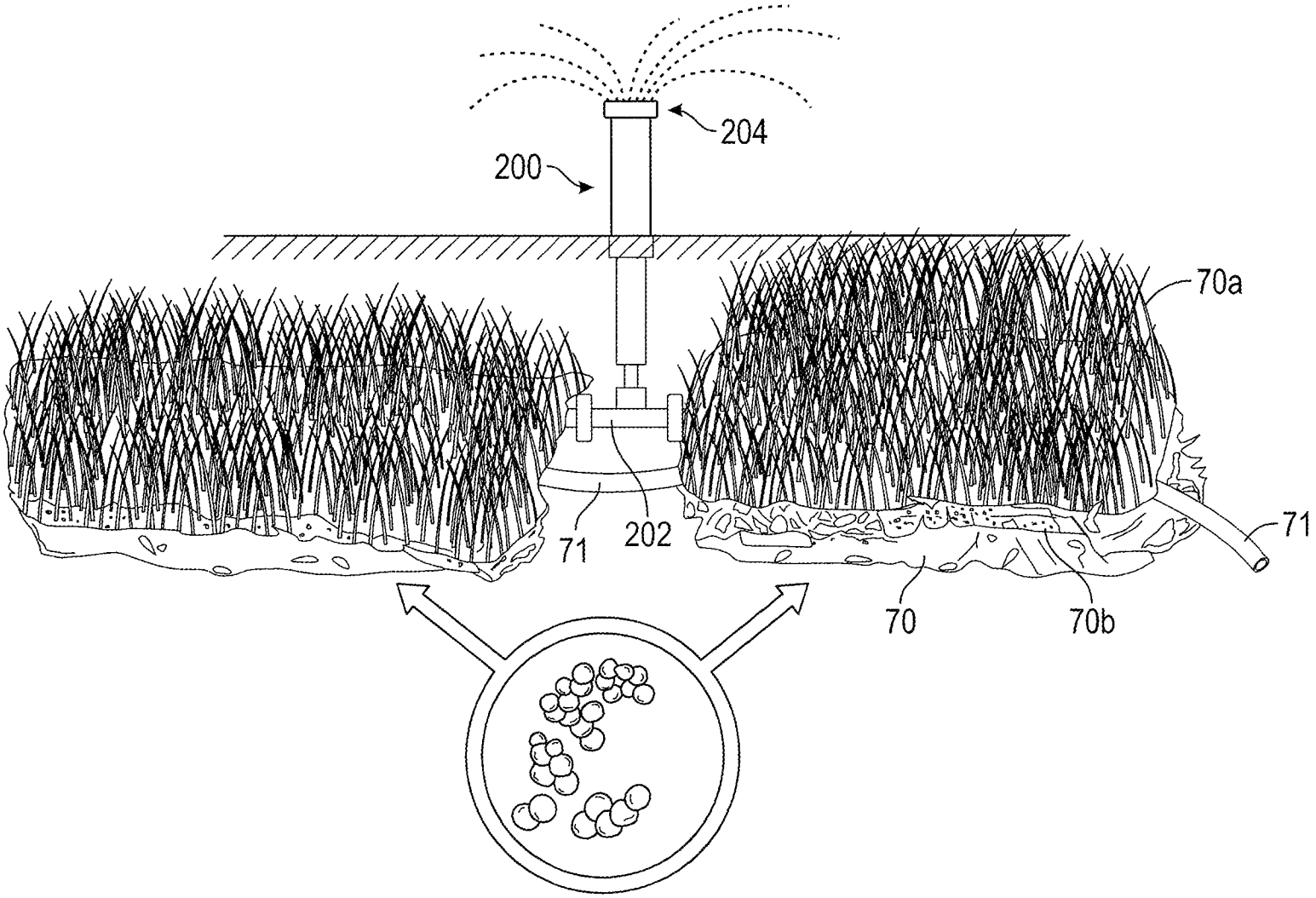
FIG. 7 is a 3D illustration of a drip irrigation system in use with hair compounded mats according to the present invention.

The inventive method uses drip irrigation hoses that are placed on top or sandwiched between two mats 70 (FIG. 7). Mats 70 can range in different sizes and depth. The drip irrigation provides water, fertilizer, and weed suppressant treatment if needed. Mats can be pre-treated to contain fertilizer and weed suppressants. However, in order to fully appreciate the scope of the present invention, the composition and variations of the mats will be first described below.

The mats and related forms thereof are formed according to a method for enhancing plant growth that involves collecting natural fibers—particularly, natural African hair—to enhance plant growth, rolling the group of hair fibers into balls or bundles when operated upon by a cleaning assembly 20 having an agitator 21, infusing a liquid fertilizer solution into the cleaned fibrous bundles, and packing the infused bundles into a mesh bag 50 for deposition into or atop soil on or near the roots of a plant planted in a soil layer.

Preferably, natural hair fibers from African-American men may be collected in large quantities used for use in the present invention, such as may be collected in barbershops, salons, hospitals, and the like. Collecting hair fibers may seem extreme at first; however, hair of African-descent has important qualities that are advantageous to horticulture and, therefore, critical to the present invention. While hair fibers from persons of African descent are preferred, they may be successfully combined with hair fibers taken from persons of non-African descent or even some animals. It is understood that the step of collecting hair fibers may include a computer software "app" running on a mobile electronic device such as a smart phone or tablet.

Hair is a living organism and serves the same purpose even if it is no longer attached to the follicle. Melanin filled African American unprocessed hair carries a unique characteristic. One main component is its melanin properties to absorb good ultraviolet light and warmth. The more sunlight that is in the presence of melanin the more melanin is produced. African unprocessed hair is extremely dry on the outer surface, but moisture is stored near the scalp (the root system).

Melanin has powerful detoxification high anti-toxic potential and control over enzymatic process. All chemical reactions in living organisms are catalyzed by enzymes. For example, the soil changes, becomes dry. The protein water or protein absorbs the substrates on their surfaces and enhance the reaction i.e., formation of the product. (Enzymatic Process).

In another important aspect, the method steps described above are preferably carried out in conjunction with a specific apparatus 10 or system. More particularly, the apparatus 10 for enhancing the growth of a plant according to the present invention includes a cleaning assembly 20, a fertilizer bin 30, and a wastewater reservoir 40. More particularly, the cleaning assembly 20 includes a housing 22 having a bottom wall or base and a plurality of sidewalls extending upwardly from the bottom wall and having a top wall opposite the bottom wall that at least partially connects upper edges of the sidewalls such that the walls of the housing 22, together, define an interior area that is open. Further, the top wall may define an opening 23 in fluid communication with the interior area. It will be understood that the plurality of hair fibers collected as described above may be deposited into the interior area of the housing 22 via the opening 23 or open top wall. The housing 22 may include a lid 24 that may be opened or closed to regulate insertion of hair fibers. More particularly, the lid 24 may be pivotally opened or closed, such as being mounted with a hinge between an open configuration allowing hair fibers to be inserted into the interior area and a closed configuration not allowing access to the interior area.

The cleaning assembly 20 may be in fluid communication with a water source and with a fertilizer bin 30 and with a wastewater reservoir 40 as will be described below. More particularly, the housing 22 may include a water inlet port 25 that is in fluid communication with a traditional water line. Further, the housing 22 may include a fertilizer port 26 in fluid communication with the fertilizer bin 30, such as via an incoming connecting tube 27. There may also be a fertilizer return tube 27*a*. Similarly, the housing 22 may be in fluid communication with the wastewater reservoir 40 via another connecting tube 42. The actuation of communications between the cleaning assembly 20, fertilizer bin 30, and wastewater reservoir 40 may be controlled by electronic controllers or processors and programming as would be known in the art.

Further, the cleaning assembly 20 may include and outer water tub 20*a*, an inner wash tub 21*b* inside the outer water 20*b*, and an agitator 21 situated in the interior area of the inner wash tub 20*b*. The agitator 21 may be a rod having arms or fins that extend laterally and may be electrically connected to a motor 28 which may be connected to a power source such as an AC connection or battery. The agitator 21 is operative via a pump 29 to rotate when the motor is energized with electricity and water has been introduced into the housing 22. In other words, the agitator 21 rotates and generates rotational currents when a wash cycle is initiated, whether by a user input (e.g., a user pressing a start button) or by a software instruction. Preferably, a plant-based cleanser or detergent, water, and the plurality of hair fibers are received into the interior area of the housing 22 and a wash cycle is initiated such that dirt and salt are removed from the hair fibers. It is understood that the water—referred to herein as wastewater—may be drained from the interior area into the wastewater reservoir 40 at the end of a wash cycle.

In addition, the rotational currents generated by rotation of the agitator 21 may cause an intertwining or entanglement of the plurality of hair fibers. Specifically, the agitator 21 may have a shape configuration that causes the hair fibers to form what will be referred to as a bundle 60 of hair fibers, such as in the form of a ball, hairball, or cube.

A liquid fertilizer solution is contained in the fertilizer bin 30 and is transferred to the cleaning assembly 20 after the wastewater has been drained from the housing 22 following a wash cycle, at other predetermined times, or when actuated during a cleaning cycle. The fertilizer solution includes a water-soluble fertilizer. When actuated, a predetermined quantity of the fertilizer solution is delivered to the housing 22 where it is infused into the at least one bundle and, preferably, a plurality of bundles, of hair fibers. The fertilizer may include a compost material, referred to as compost tea. Preferably, the ingredients of compost tea include non-chlorinated water, unsulfured blackstrap molasse, kelp fertilizer, and fish fertilizer. Compost tea is a mixture of nutrients and oxygen-loving (aerobic) bacteria, fungi, nematodes and other microbes that live in finished compost.

In an embodiment, the step of depositing fertilizer into the cleaning assembly 20 may be repeated, including the steps of cleansing and agitation. The agitation process causes a bundle to absorb the infused water-soluble fertilizer. Then, the cleaning assembly 20 is operable to conduct a spin cycle to remove excess water-soluble fertilizer and actuate its return to the fertilizer bin 30 where it may be recycled and re-used. Finally, the cleansed and fertilizer-infused bundles may undergo a drying and decomposition process.

Figure 6:
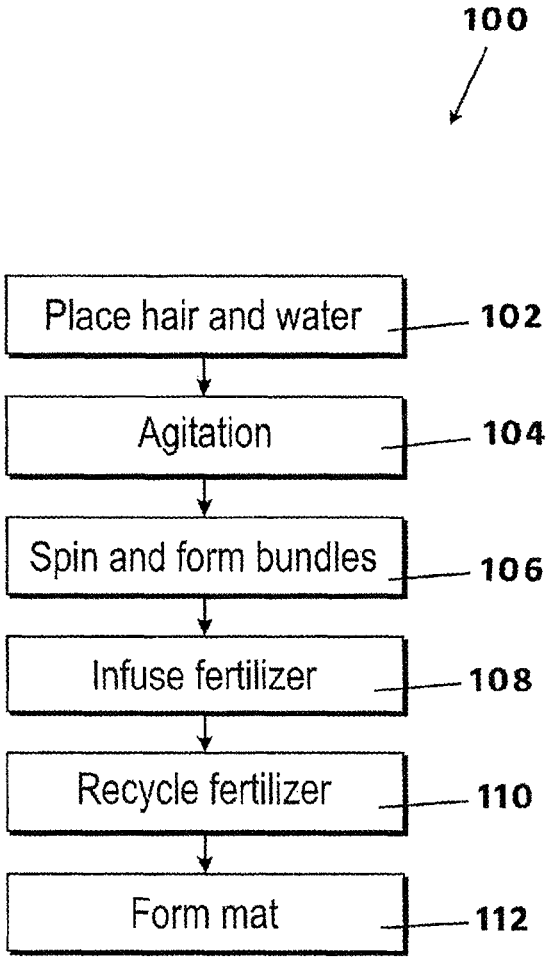
FIG. 6 is a flowchart illustrating a method for enhancing growth of a plant according to a preferred embodiment of the present invention.

The overall process 100 for enhancing growth of a plant is illustrated in FIG. 6 and is representative of the method described above. Specifically, block 102 represents depositing water (preferably non-chlorinated water) into the cleaning assembly along with African-American hair fibers to be cleansed. Further, block 104 represents the step of actuating the cleaning assembly 20 to perform an agitation process intended for cleansing the fibers and forming up one or more hair bundles 60 or cubes. Next, the cleansing assembly 20 is operable to perform a spin cycle to remove water from the hair bundles 60 and spin them up and shape them and actuate a return of the removed water to the wastewater reservoir 40, as indicated at block 106. From here and referred to by block 108, the fertilizer bin 30 may be actuated to deliver fertilizer (e.g., compost tea) for infusion into the cleansed hair bundles 60, followed by another agitation process 110 and fertilizer recycling process (repeat of prior steps). A final step 112 may include sewing the cleansed and fertilizer bundles 60 to form a mat 70, such as via a felting process and using a felting machine, for placement on or under a soil surface proximate a plant/turf whose growth is to be enhanced. Mat 70 is also used as a buffer between soil and turf as a nutrient and water reservoir.

Figure 1:
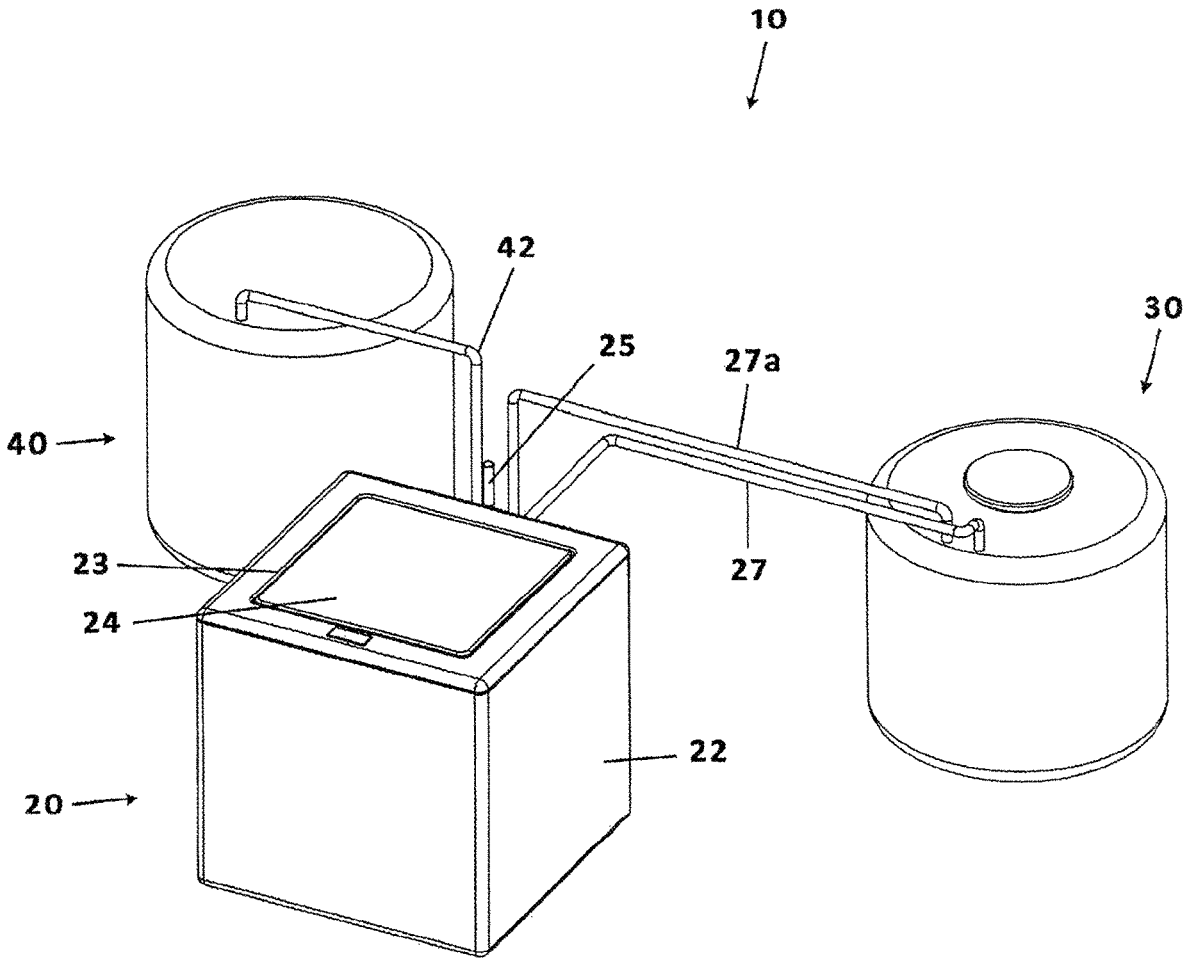
FIG. 1 is a front perspective view of an apparatus for enhancing growth of a plant according to a preferred embodiment of the present invention.
Figure 2:
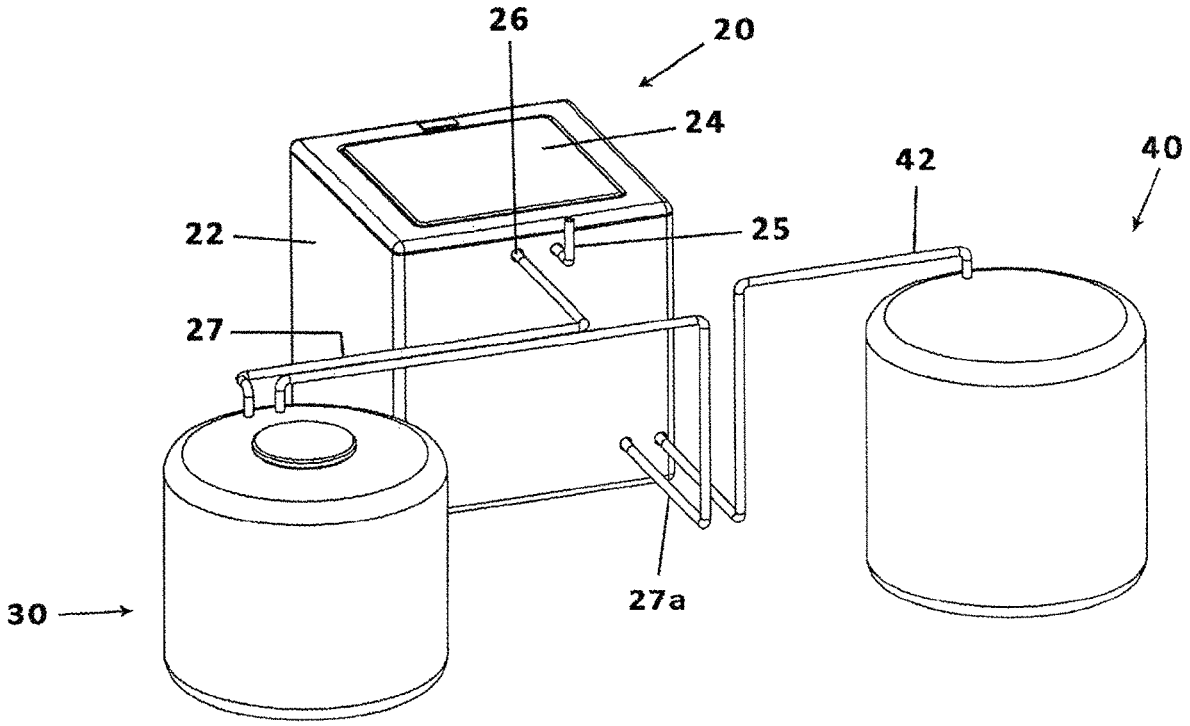
FIG. 2 is a rear perspective view of the apparatus as in FIG. 1.
Figure 3A:
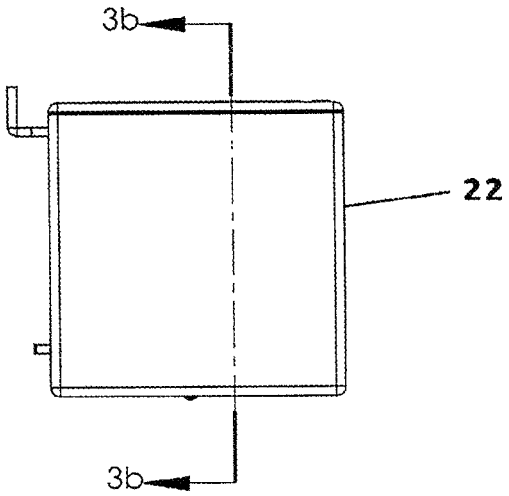
FIG. 3*a* is a side view of the cleaning assembly removed from the apparatus of FIG. 1.
Figure 3B:
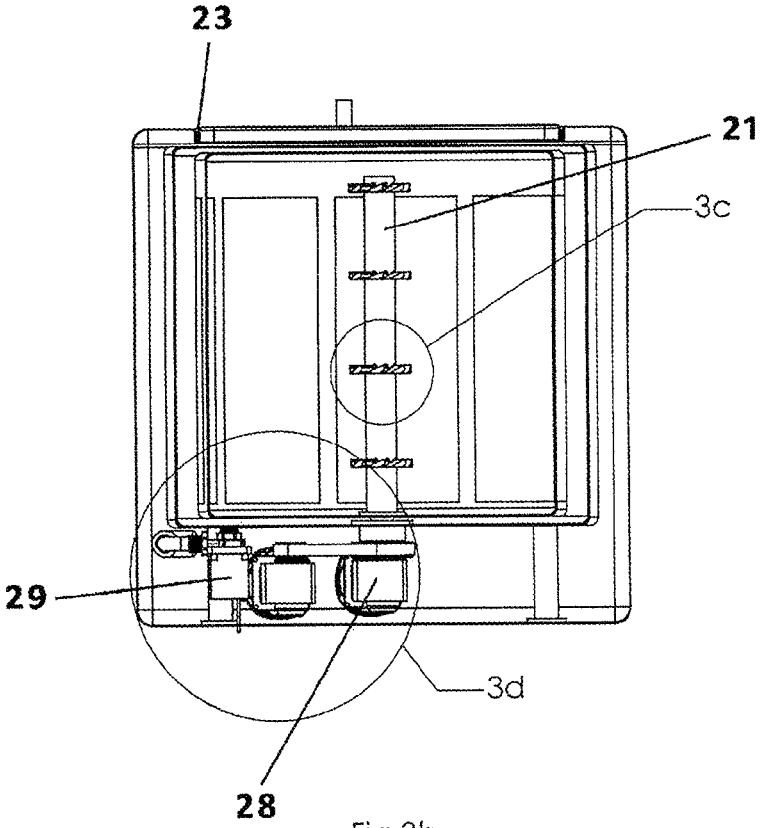
FIG. 3*b* is a sectional view taken along line 3*b*-3*b* of FIG. 3*a;*
Figure 3C:
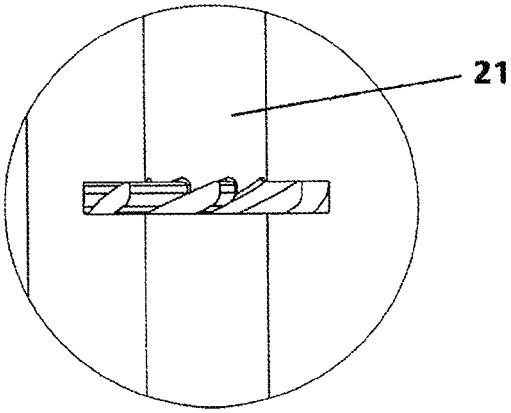
FIG. 3*c* is an isolated view of on an enlarged scale taken from FIG. 3*b;*
Figure 3D:
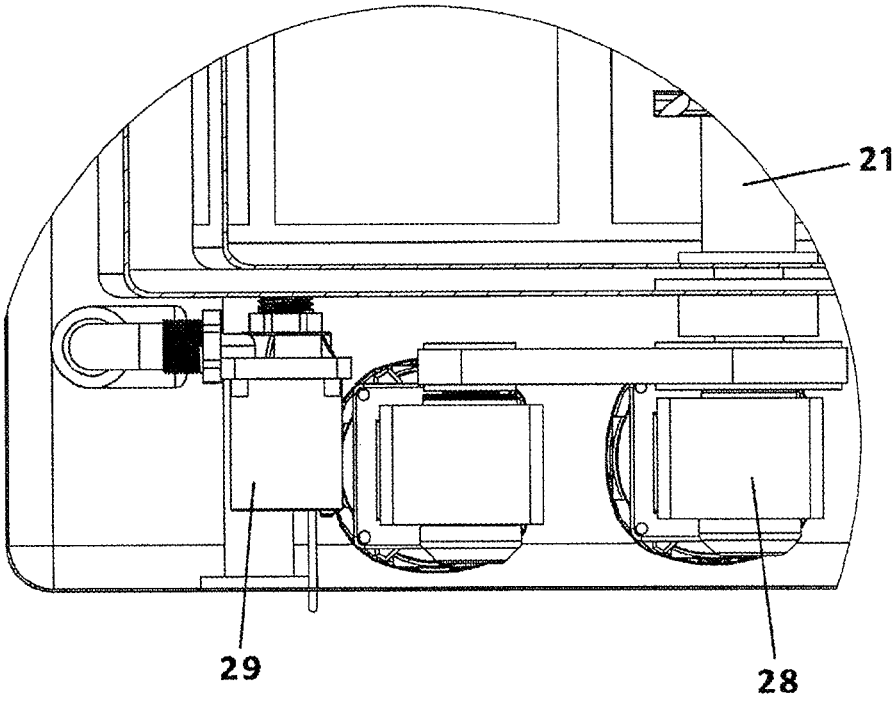
FIG. 3*d* is an isolated view of on an enlarged scale taken from FIG. 3*b;*
Figure 4A:
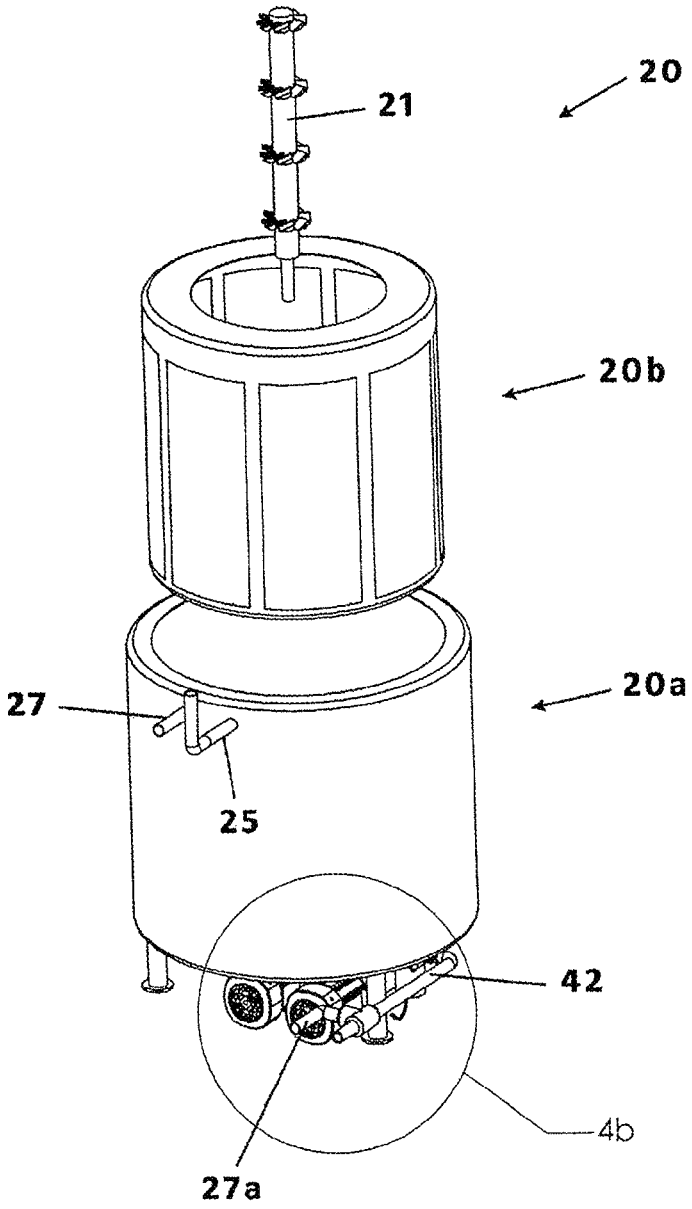
FIG. 4*a* is an interior exploded view of the cleaning assembly of FIG. 2*a;*
Figure 4B:
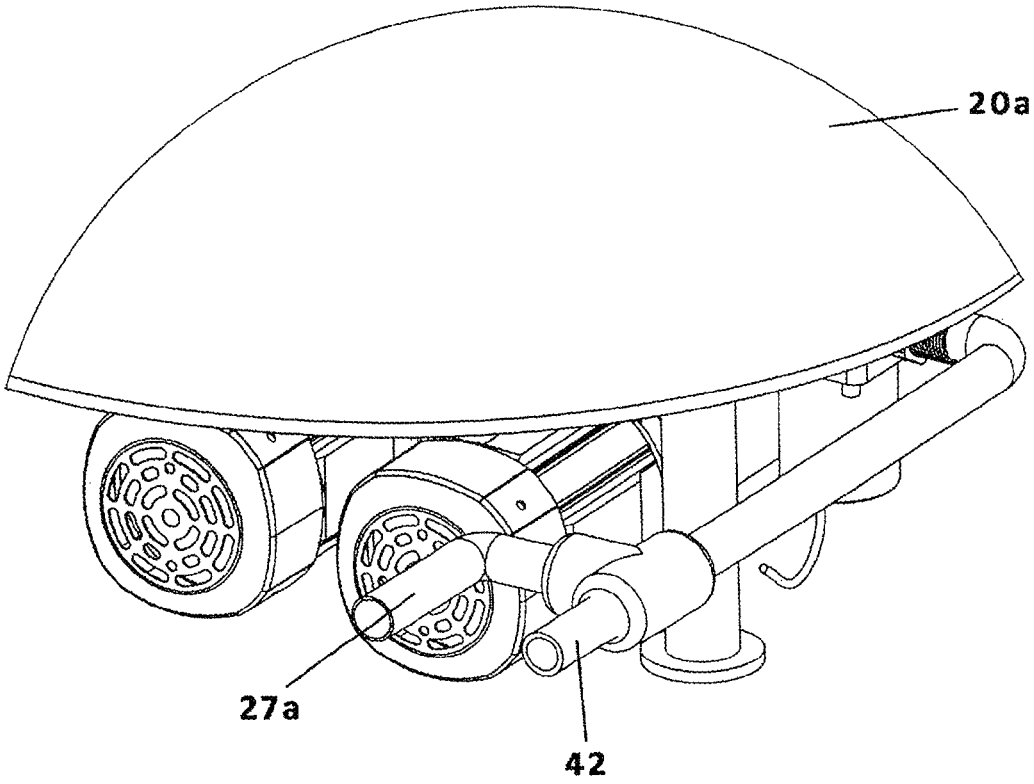
FIG. 4*b* is an isolated view of on an enlarged scale taken from FIG. 4*a;*
Figure 5A:
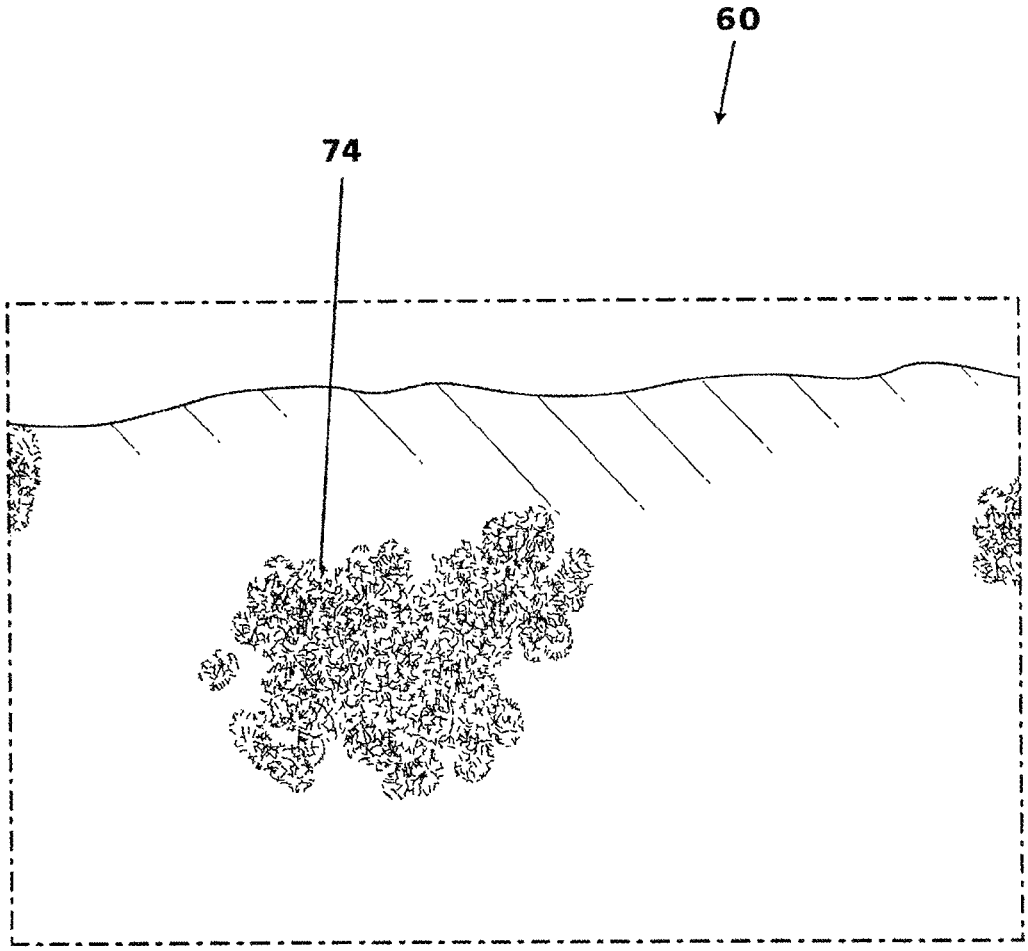
FIG. 5*a* is an isolated view on an enlarged scale of a powder form of a hair bundle according to the present invention.
Figure 5B:
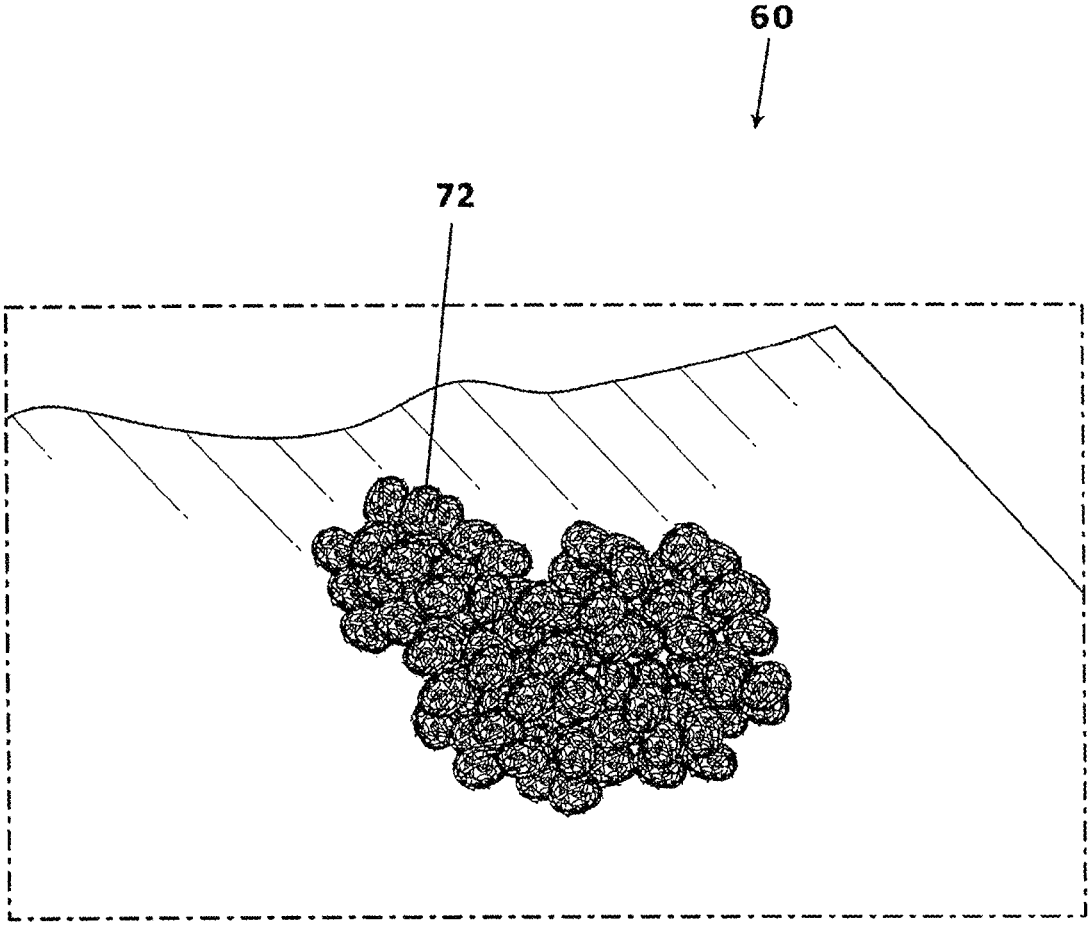
FIG. 5*b* is an isolated view on an enlarged scale of a ball form of a hair bundle according to the present invention.
Figure 5C:
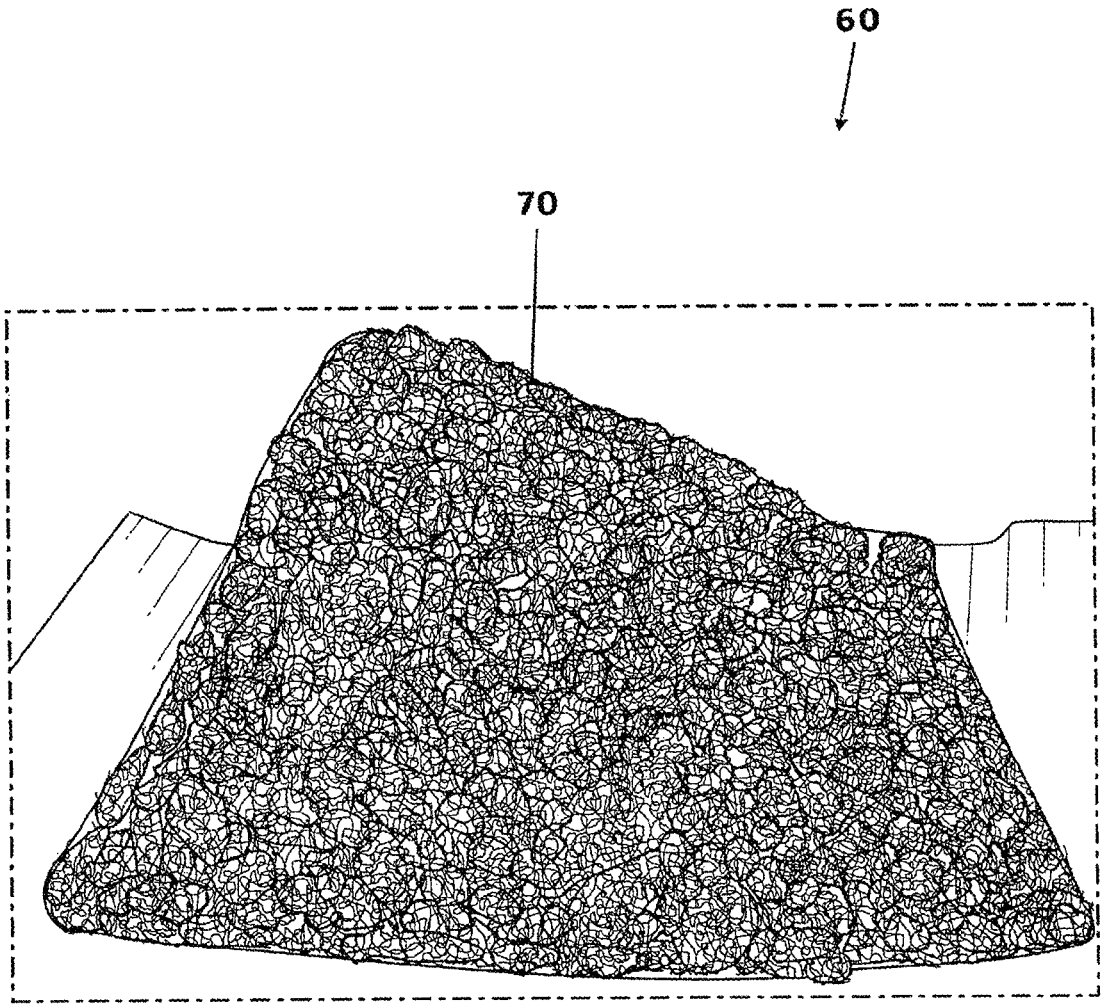
FIG. 5*c* is an isolated view on an enlarged scale of a mat of hair fibers according to the present invention.

With reference to the one or more bundles 60 using hair fibers, there are at least three types of bundles that may be formed according to the present invention. Specifically, a bundle 60 may be in the form of a mat 70, pellet balls 72, or powder 74 as shown in FIGS. 4C, 4B, and 4A, respectively. More particularly, the mat 70 is an article derived from African-descent hair using a needle-felting process with a burlap material between top and bottom layers of hair. More particularly, hair is placed on the top and bottom of a coarse woven canvas derived from natural eco-friendly fiber (Burlap). Using a needle-felting machine, special needles containing grooves are aligned so that hair placed on top is grabbed by grooves in the needles and pushed through the burlap and attached to the hair placed on the bottom of the burlap. Hair placed on the bottom of the woven canvas material is also grabbed by needles as well, is pulled from the bottom to attach itself to the top layer, and forms a carpet-like mat. The mat 70, then, may be placed on or below a soil layer proximate to the plant whose growth is to be enhanced. Accordingly, the plant will reap the benefit of the infused fertilizer and melanin rich hair fibers.

In the case of pellet balls 72, they may be placed directly into the soil or used as a soil amendment. This form of a hair bundle 60 may be formed using the cleansing and agitation process described previously. In this instance, the process of cleansing the hair, storing the water removed from cleansed hair, and infusing compost tea or fertilizer are critical steps. Regarding the powder 74, the powder form may be added to soil to amend the textures in the soil to improve nutrient availability. Further, the various forms and arrangements of hair bundles 60 may be used for irrigation, insulation, building materials such as tile, and other fire suppression applications as will be described later in greater detail.

In an embodiment, the apparatus 10 may include a porous container for containing an infused bundle 60 and insertion of a bundle into the porous container is then applied to a soil layer immediately adjacent or proximate to a plant (e.g., seed, flour, tree, vegetable, or the like). This embodiment was shown and described in the related application identified above and is incorporated herein by reference. The porous container may be a mesh bag, a square packet, or some other packaging that includes a construction suitable for a slow release of moisture and fertilizer. For instance, a mesh bag is a preferred porous container that is constructed of a plurality of threads arranged in a spaced apart or honeycomb arrangement that is advantageous for a slow release of the contents of the bag, such as a release of water and fertilizer. In addition, the mesh bag has an open neck and defines an interior space—the open neck being dimensioned and suitable to receive a bundle 60 into the interior space. In addition, the mesh bag allows the roots of a plant to grow up in and through its outer surface so as to contact the contents inside. Preferably, the bag may be constructed of paper or a paper-based material that may decompose or otherwise allow roots to extend or grow therethrough.

It is understood that the thread pattern of the mesh bag is suitable for containing the bundle 60, i.e., keeping the ball from unraveling as it slowly drips its contents into the soil. In addition, the mesh bag may include a drawstring that is threaded around the neck and operative to close the opening when the drawstring is pulled, such as after a bundle has been received into a mesh bag.

Turning now to the present invention of fire suppression, mats 70 may be placed underneath the sod and turf and used as defensive barriers to stop fires from spreading and burning homes and property, and for water conservation. Marketed as the "Forsee mats," respective mats 70 hold water and provide nitrogen to sod/turf which renders it flame and fire resistant.

According to the present invention, the preferred method uses drip irrigation hoses that are placed on top or sandwiched between two mats 70 (FIG. 7). Mats can range in different sizes and depth. The drip irrigation provides water, fertilizer, and weed suppressant treatment if needed. In an embodiment, mats 70 can be pre-treated to contain fertilizer and weed suppressants.

Figure 8:
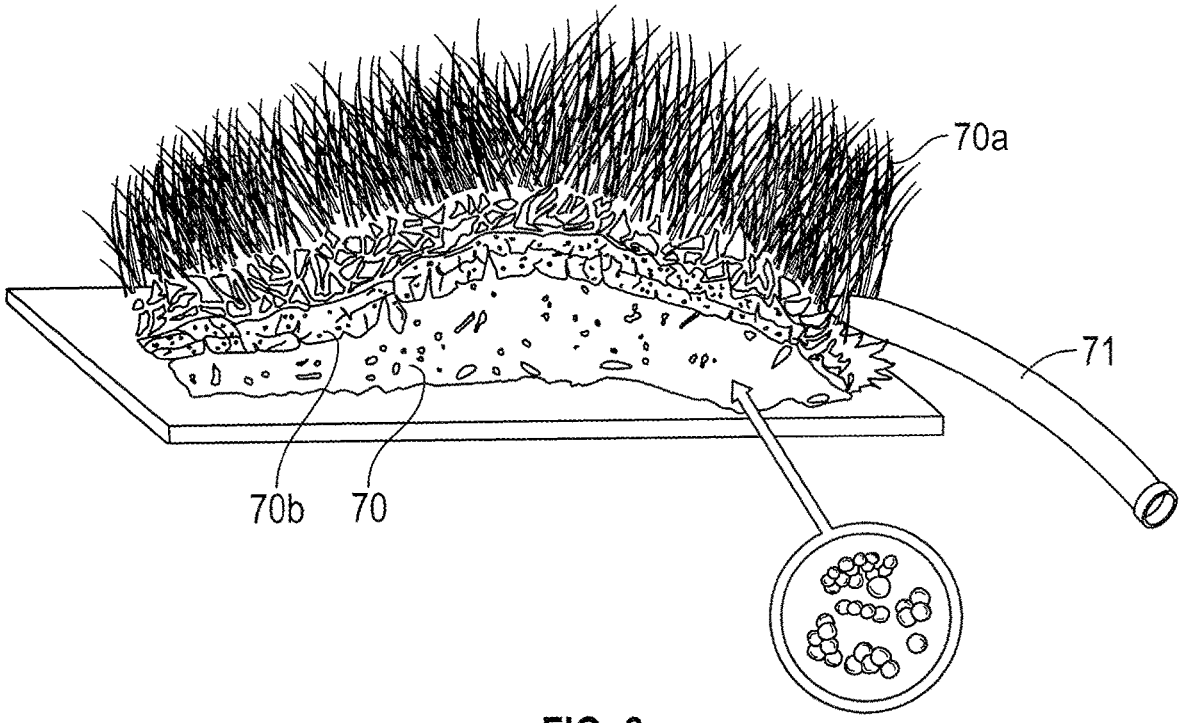
FIG. 8 is an isolated view on an enlarged scale of a mat taken from FIG. 7.

More particularly, utilizing the various forms for the hair bundles 60 for extinguishing or suppressing a fire will now be further described. As described above, the infused bundle 60 may be shaped in the form of a mat 70. Accordingly, the mat 70 may be positioned beneath a layer of sod or grass 70*a* and a layer of soil 70*b* (FIG. 8). Preferably, the present invention serves as an underground fire alarm system. In an embodiment, the drip irrigation system 200 includes a drip irrigation hose 202 by which one or more mats 70 may be coupled together such that respective mats 70 are in fluid communication with one another and with the drip irrigation system 200 which includes a water source (e.g., a water tap). It will be understood that a plurality of mats 70 may be coupled together by a network of drip irrigation hoses 202. When fires or wildfires are imminent, the irrigation drip system 200 may be actuated so as to begin to saturate the sod and may include a sprinkler device 204 for irrigating from a top surface if needed. It will be understood that each mat 70 is configured to hold/absorb a large quantity of water and becomes saturated in due course along with the layers of soil and vegetation so as to resist progression of a fire event. A drip tube 71 may extend from the mat 70 into the adjacent soil and vegetation to provide extra water remote from the mat 70 (FIGS. 7 and 9).

Accordingly, a residence or business may be protected with a properly configured drip irrigation system 200*a* and plurality of mats 70. More particularly, this method is used in case fire embers land on vegetation or grasses near a home. Flame resistant and water-holding mats 70 form a defensive barrier around the home, buildings and subdivisions. Developing drip irrigation underneath sod and turf that roots quickly attach to respective mats 70. Respective mats quickly absorb and hold water and serve as a reservoir for the sod, as well as to act as a fire retardant.

Figure 9:
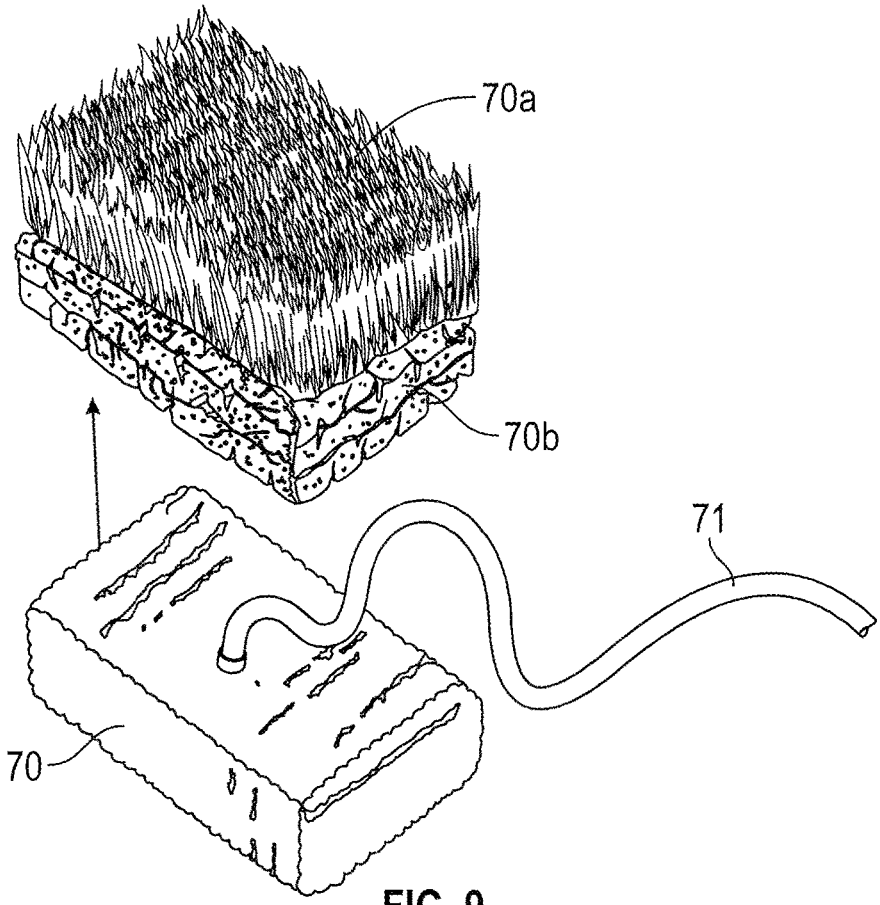
FIG. 9 is an exploded view of a mat as in FIG. 8.

In another aspect and with specific reference to FIGS. 8-9, a water conservation characteristic of the invention is described in more detail. With the use of the irrigation drip system 200, less water application is needed. Preferably, water provided from the drip irrigation system 200 goes directly to where water is needed—namely, to the root system proximate the mat 70. Traditional irrigation water delivered only from the top will take time to saturate to the roots. In hot climates, water evaporation can occur before roots can utilize the water. In instances where the soil is heavily compacted, water can sit on top of the ground which can cause issues. In an embodiment, the drip irrigation system 200 may include an input valve that is configured to receive additives such as fertilizer, weed suppressants, and the like for communication to the mat 70 or plurality of mats 70. A drip tube 71 may extend from the mat 70 into these soil and vegetation adjacent the mat 70. In an embodiment, by contrast, one or more mats 70 may be pretreated with fertilizer, weeds present, and the like.

Figure 10:
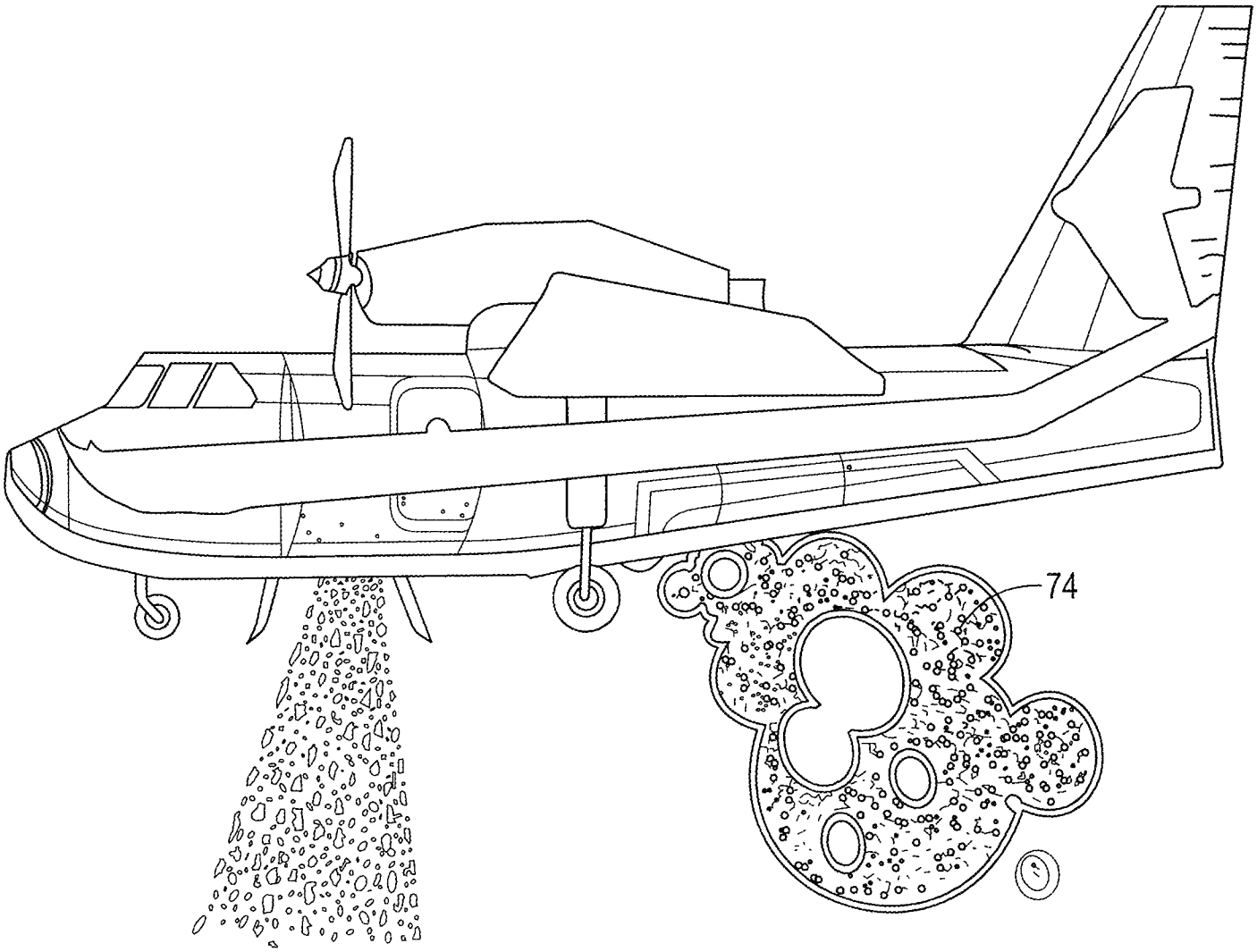
FIG. 10 is a perspective view of a pellet form and a powder form of a compounded fertilizer product being dispersed from a fire-fighting aircraft according to the present invention.

With specific reference to FIG. 10, the present invention discloses its use as fire suppressants and retardants in a form configured for aerial delivery. More particularly, the use of ammonium phosphate in fire suppressant and retardants can be replaced by the use of Afro hairs. Afro hairs, like ammonium phosphate, have a high nitrogen content. Nitrogen sources also play a role in char layer formation. The char layer formation seals a gap from further flames and oxygen in the event of fire. The high level of salt contained in Afro hair can deprive a fire of oxygen. In an embodiment, mixing colloidal silica nanoparticles with cellulosic biopolymers yields multivalent, non-covalent crosslinking interactions that generate a viscoelastic fluid with desirable mechanical properties and spray characteristics. These gels are only effective when wet and do not stop fires once the water has evaporated which often occurs in under an hour during normal wildland fire conditions. As a result, these gels cannot be used for long-term preventative treatment of wildland fuels. These hydrogels can be used to carry Afro hair fibers and form a homogenous suspension and serve as effective fire retardants that could adhere to wildfire-prone vegetation to prevent wildfire formation at high-risk sources of ignition and decrease water evaporation. Decreasing water evaporation can increase wild fire/fire retardant time capacity. Other additives mixed in aqueous formulations contain polymeric viscosity modifiers (i.e., guar gum and clay particles).

Figure 11:
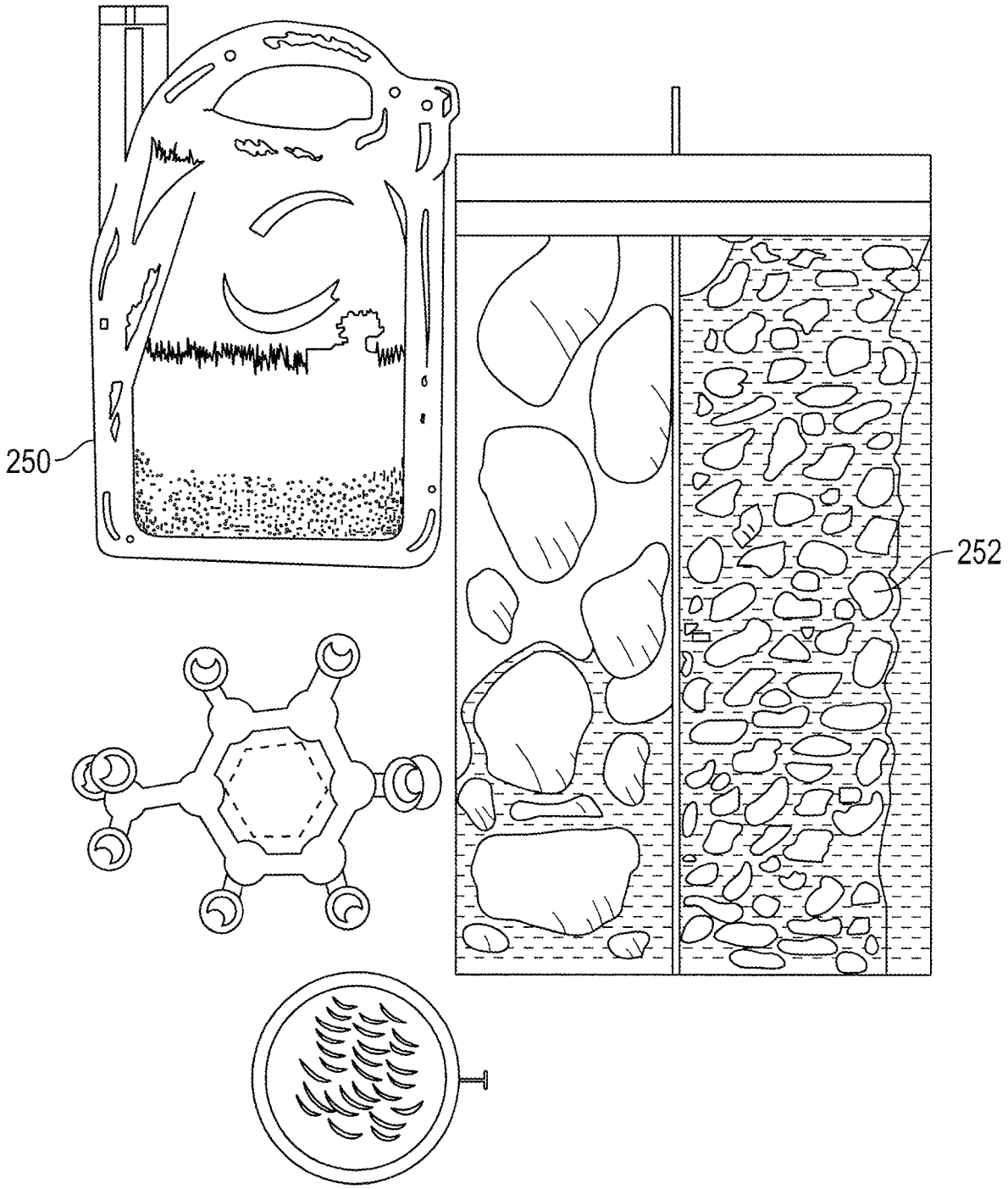
FIG. 11 is a schematic illustration of hair fibers according to the present invention having bonded to the chemical Paraquat™.
Figure 12:
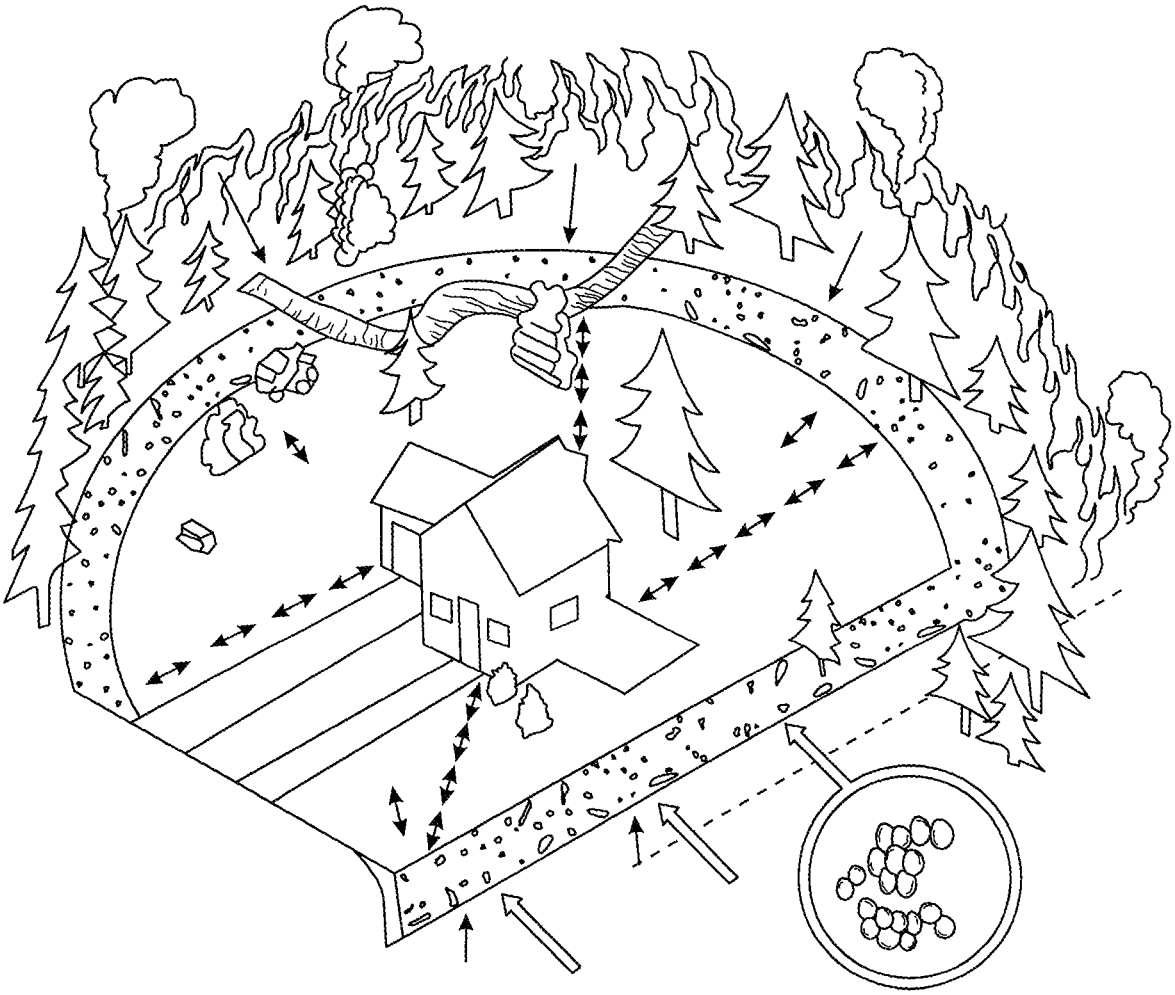
FIG. 12 is a plan view illustrating usage of the present invention for fire suppression in a residential environment according to the present invention.

In another aspect, it is noted that melanated Afro hairs (highly pigmented) bind to the chemical marketed as Paraquat 250 (FIG. 11). The bisquaternary ammonium compound paraquat, which is widely used as a herbicide, is readily bound to melanin. It is known that metal ions show a strong affinity for melanin, which can be ascribed to a cation binding activity 252, of anionic groups on the melanin polymer. This cation-binding activity also seems to be important for the binding of paraquat to melanin. Powdered afro fibers mixed in soil or herbicides can decrease chemical movement through the soil. This action can decrease chemical movement through the soil profile. Fertilizers and herbicides moving too quickly through the soil profile can contaminate groundwater. The present invention prevents that from happening.

In another aspect, Afro hair efficiency and ability to withstand high temperatures can prove to be an efficient product in the manufacture of firefighter clothing. Afro hair has the ability to regulate temperature and provide cooler temperatures underneath. Afro hair does not melt or stick to the skin when exposed to high temperatures. These same properties can be applied to insulation techniques for homes. Represented by FIG. 12, the application for insulation can make homes less flammable, but holding cooler temperatures indoors.

Figure 14:
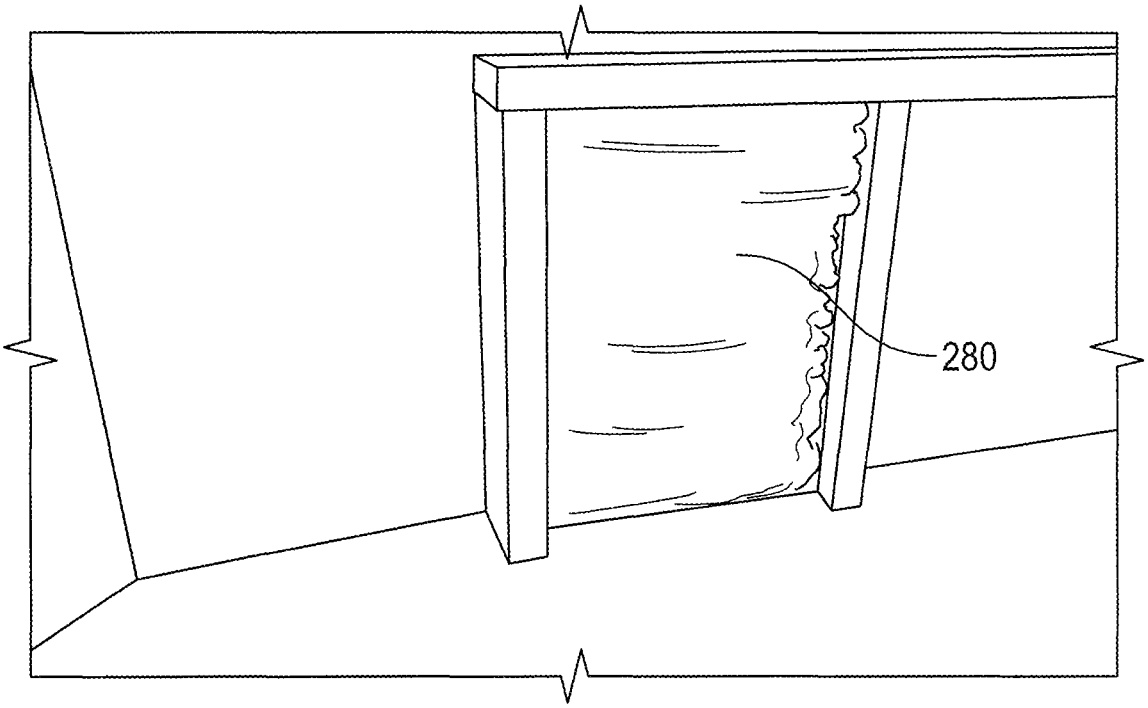
FIG. 14 is a perspective view of powdered hair fibers according to the present invention in use as a fire-retardant insulation in a wall.
Figure 15:
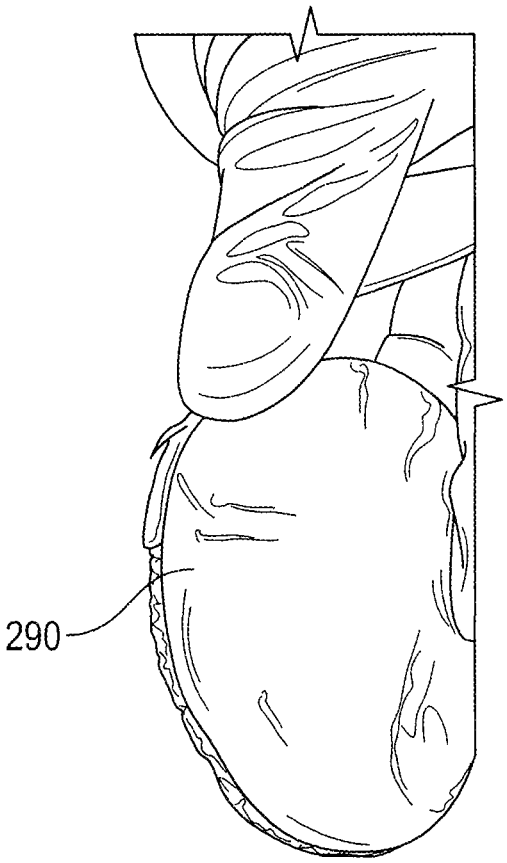
FIG. 15 is a graphical illustration of compounded hair fibers according to the present invention in use as a fire retardant in the form of a tile.

Still further, there are numerous other benefits and uses for the collected Afro hair. The additional procedures, uses, and experimentation beyond the collection and cleansing described above will now be discussed in greater detail. For instance, Afro hair may be incorporated and used with wall insulation panels, i.e., as a construction material more resistant to fire. (FIG. 14 at 240)

Figure 13:
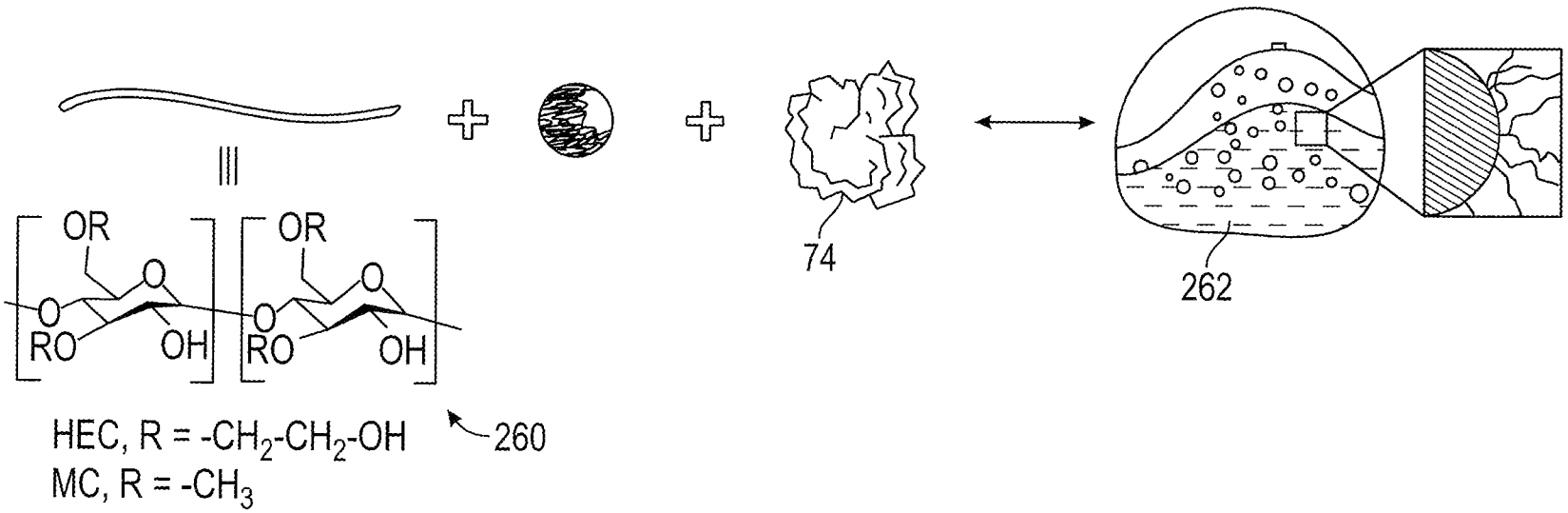
FIG. 13 is a schematic drawing of compounded hair fibers used as a fire retardant.

As shown in FIG. 13, Afro hair, such as in a powder form 74, can be treated or mixed with other chemicals 260 to generate materials that are resistant to melting and which may, therefore, be utilized as a fire suppressant 262 or, at least, naturally resistant to the effects of a fire event. More particularly, thermoplastic polyurethane may be dissolved in dimethylformamide (DMF) with the powdered form of Afro hair (described previously) so as to form a homogenous liquid that, when subjected to high temperatures, generates a rubber-like tile 290. Further, thermoplastic polyurethane may be mixed with Afro hair and subjected to high temperatures to generate a material that is resistant to melting. Again, a material that is naturally resistant to the effects of a fire event is a result of the collected and cleansed Afro hair.

Figure 16:
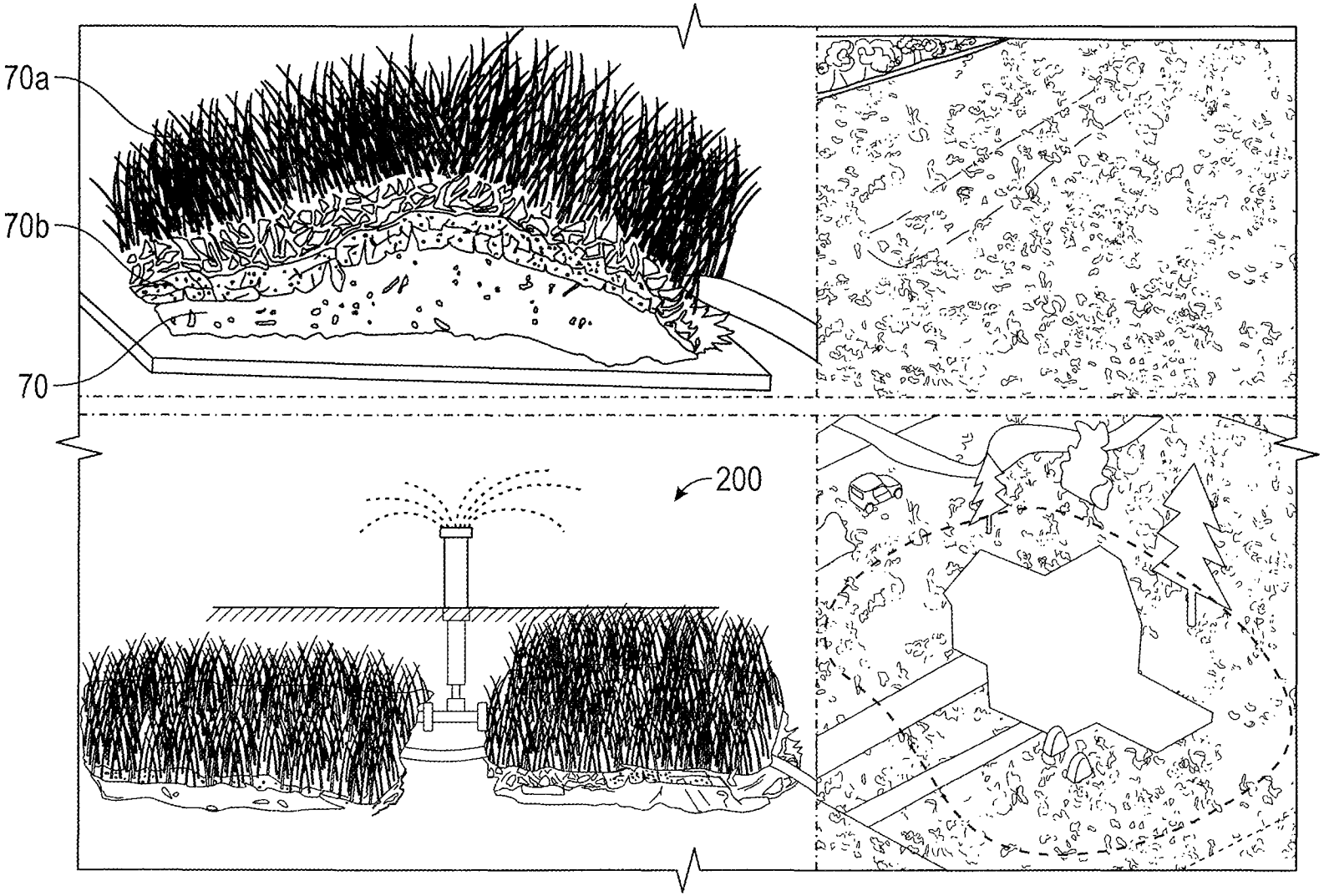
FIG. 16 is a graphical illustration of a use of the present invention for lawn irrigation.

Further, a hydrogel that includes viscoelastic fluid may be mixed with Afro hair fibers and water so as to form a homogeneous suspension configured for application as a fire retardant when applied to vegetation. It is understood that such a mixture may be added as an additive to the drip irrigation system 200 (FIG. 16).

In another embodiment, a predetermined quantity of collected Afro hair may be cleansed and dried in a manner substantially as described in this application and then fed through a biomass feeder. Then, a pyrolysis applies high temperatures so as to initiate a carbon process. Further pyrolysis breaks down the fiber structure and improves the grinding process. Gases produced by the biomass reactor can be used for energy, such as for heating water.

In an embodiment, a mat 70 like one as described above, may be punched and attached to burlap so as to generate a material having the following benefits: 1) that is not damaged by moisture but rather pulls moisture into itself, 2) that is resistant to formation of mold/mildew, and 3) that regulates temperature.

Figure 17:
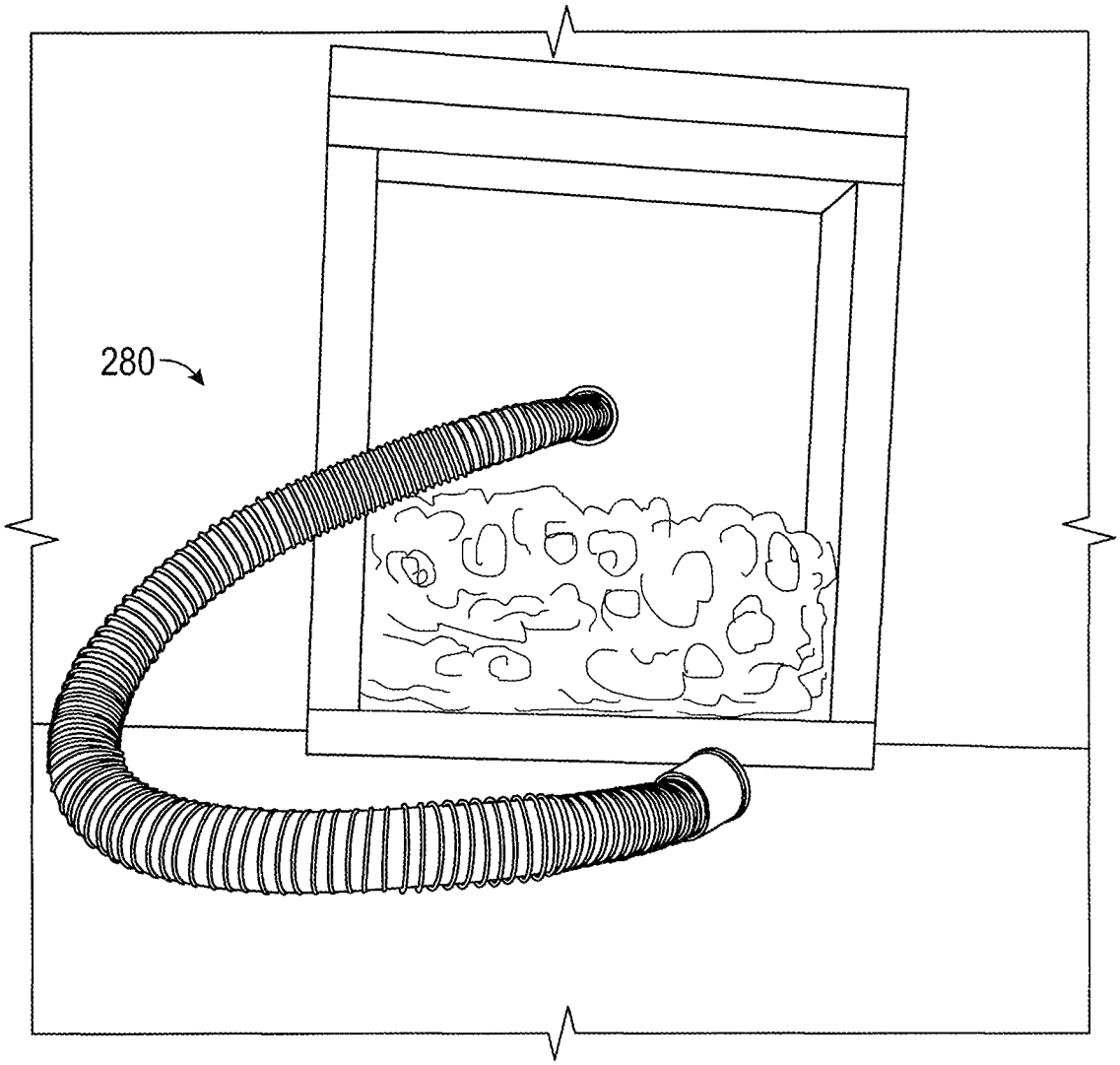
FIG. 17 is a perspective view of compounded hair fibers according to the present invention in use as a fire retardant as blow-in insulation.

In an embodiment, Afro hair may be cleansed as first described above and a predetermined amount may be inserted into a cloth bag that undergoes another agitation process where it may be formed into balls and used for blow-in insulation as illustrated in FIG. 17 and referenced as 280.

It is understood that while certain forms of this invention have been illustrated and described, it is not limited thereto except insofar as such limitations are included in the following claims and allowable functional equivalents thereof.

The invention claimed is:

1. A method for slowing or suppressing a fire event, comprising:

collecting a plurality of hair fibers;

depositing said plurality of hair fibers into a cleaning assembly having a housing that defines an opening in fluid communication with an interior area capable of receiving said plurality of hair fibers via said opening;

said cleaning assembly having an agitator situated in said interior area that is electrically coupled to a motor, said motor being configured to rotate when said motor is energized for cleansing said plurality of hair fibers;

cleansing and agitating said plurality of hair fibers deposited in said cleaning assembly;

wherein said agitator has a shape configuration that intertwines said plurality of hair fibers when energized;

while in said cleaning assembly, said agitator shaping said plurality of hair fibers into a bundle;

containing a liquid fertilizer in a fertilizer bin in communication with said cleaning assembly:

infusing a water and nitrogen solution into said bundle;

forming a mat from said infused bundle; and positioning said mat on or into sod or turf;

connecting said mat to another mat via a drip irrigation hose for fluid communication therebetween such that said connected bundles are saturated with water when the drip irrigation hose is actuated.

2. The method for slowing or suppressing a fire event as in claim 1, wherein the drip irrigation hose includes an input valve configured to receive water, fertilizer, or weed suppressant additives.

3. The method for slowing or suppressing a fire event as in claim 2, wherein the drip irrigation hose includes a network of drip irrigation hoses and wherein the step of connecting said mat to another mat includes connecting said mat to a plurality of mats.

4. The method for slowing or suppressing a fire event as in claim 1, wherein the step of positioning said mat includes positioning said mat proximate roots of a plant.

5. The method for slowing or suppressing a fire event as in claim 4, wherein said mat has a construction configured to hold a predetermined quantity of water when saturated.

6. The method for slowing or suppressing a fire event as in claim 5, wherein said mat is pre-treated with a fertilizer and a weed suppressant.

7. The method for slowing or suppressing a fire event as in claim 1, wherein said water and nitrogen solution is fire and flame-resistant.

8. The method for slowing or suppressing a fire event as in claim 7, wherein said plurality of hair fibers include African hair fibers which include nitrogen.

9. The method for slowing or suppressing a fire event as in claim 8, wherein said African hair fibers are rich in include salt such that said bundle is configured for depriving a fire of oxygen.

10. A method for slowing or suppressing a fire event, comprising:

cleansing and agitating a plurality of hair fibers deposited in a cleaning assembly having a housing that defines an opening in fluid communication with an interior area capable of receiving said plurality of hair fibers via said opening:

said cleaning assembly having an agitator situated in said interior area that is electrically coupled to a motor, said motor being configured to rotate when said motor is energized for cleansing said plurality of hair fibers;

shaping said plurality of hair fibers into a bundle when said agitator is energized, said agitator having a shape configuration for intertwining said plurality of hair fibers;

containing a liquid fertilizer in a fertilizer bin in communication with said cleaning assembly:

wherein said plurality of hair fibers includes African hair fibers that are rich in each include nitrogen;

pre-treating said bundle with said liquid fertilizer;

infusing a water and nitrogen solution into said bundle;

positioning said infused bundle on or into sod or turf;

connecting said infused bundle to another infused bundle via a drip irrigation hose for fluid communication therebetween such that said connected bundles are saturated with water when the drip irrigation hose is actuated.

11. The method for slowing or suppressing a fire event as in claim 10, wherein said water and nitrogen solution is fire and flame-resistant.

12. The method for slowing or suppressing a fire event as in claim 10, wherein said African hair fibers include salt such that said bundle is configured for depriving a fire of oxygen.

* * * * *